United States Patent [19]

Winterbottom

[11] 4,108,428

[45] Aug. 22, 1978

[54] PORTABLE PUNCH POWER GAGE

[76] Inventor: Harold E. Winterbottom, 1702 Lansing Rd., Glen Burnie, Md. 21061

[21] Appl. No.: 738,225

[22] Filed: Apr. 18, 1977

[51] Int. Cl.[2] ..... A63B 69/32

[52] U.S. Cl. ..... 272/76; 73/379; 73/709; 272/DIG. 5

[58] Field of Search ..... 272/77, 76, 78, DIG. 5; 124/79; 73/379, 380, 381, 389, 396; 273/58 R, 58 A, 58 B, 58 C, 58 BA, 55 A, 55 B

[56] References Cited

U.S. PATENT DOCUMENTS

| | | | |
|---|---|---|---|
| 650,781 | 5/1900 | Currie | 272/78 X |
| 750,593 | 1/1904 | Cady | 272/76 X |
| 777,478 | 12/1904 | Minor | 273/58 A UX |
| 1,044,987 | 11/1912 | Campbell | 272/76 |
| 1,250,905 | 12/1917 | Liljegran | 272/76 X |
| 2,115,926 | 5/1938 | Hatton | 273/58 C |
| 2,708,367 | 5/1955 | Lusk | 73/379 R |
| 3,081,634 | 3/1963 | Blaszkowski | 73/379 |

FOREIGN PATENT DOCUMENTS

| | | | |
|---|---|---|---|
| 944,634 | 11/1948 | France | 73/396 |

*Primary Examiner*—Richard C. Pinkham
*Assistant Examiner*—Arnold W. Kramer
*Attorney, Agent, or Firm*—John F. McClellan, Sr.

[57] ABSTRACT

Apparatus for use in developing boxing technique to indicate punching power during work-outs with practice equipment, includes a practice bag or the like having a punch-receiving area including pneumatic structure with connection through a releasible check-valve to a pressure gauge oriented for visibility by the person practicing.

1 Claim, 9 Drawing Figures

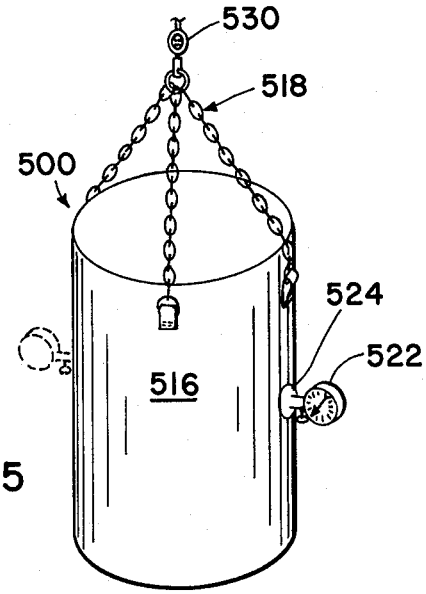
FIG. 5
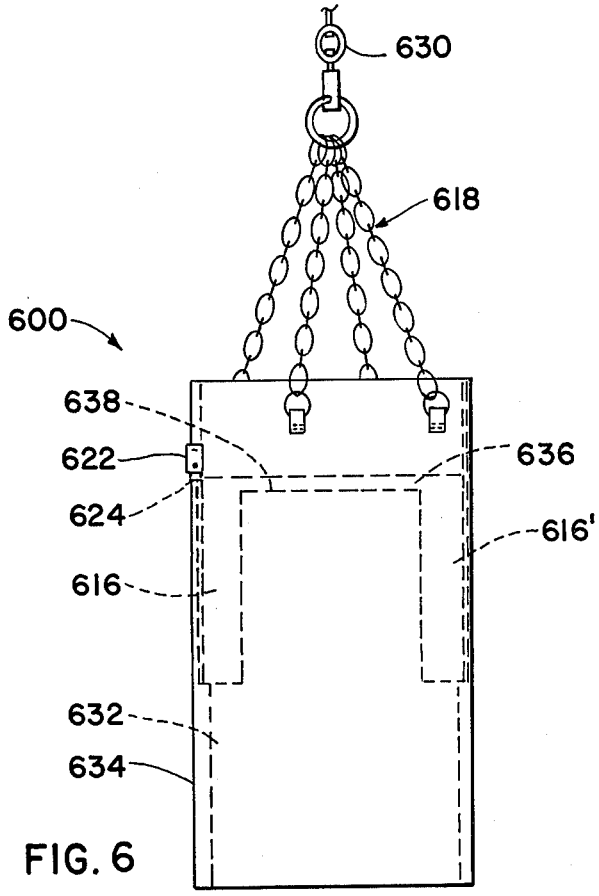
FIG. 6
FIG. 7
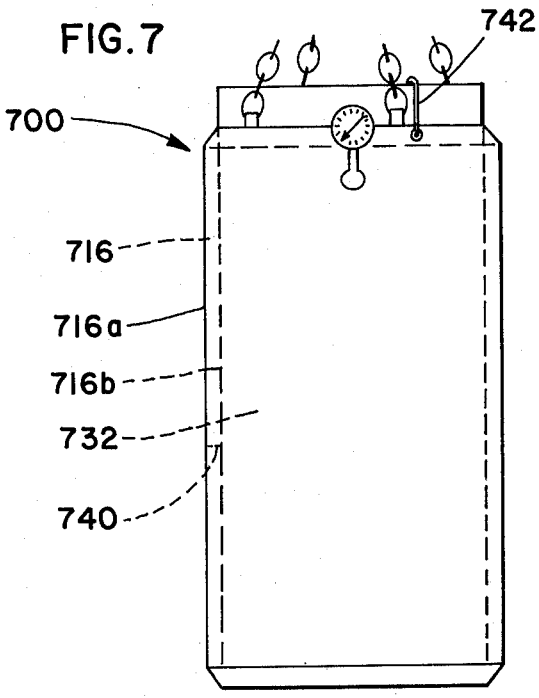
FIG. 8
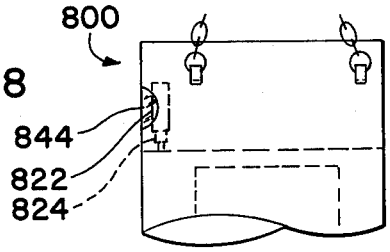
FIG. 9
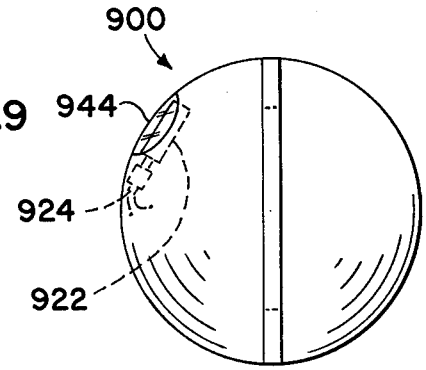

PORTABLE PUNCH POWER GAGE

This invention relates generally to athletic equipment and specifically to boxing practice equipment.

It is known in the art of boxing that punching power of a boxer increases with improvement in the boxer's technique. It is also known that in teaching, the quicker the praise or correction follows an act by the student, the more the student will profit by the praise or correction.

A principal object of the present invention is to give student boxers a system for measuring improvement in technique by indicating in absolute terms, and instantly upon each punch, improvement or lack of improvement in their punching power.

A further object is to provide a system as described which gives the student instant feedback on his punching power in a variety of situations, from heavy bag to simulated live body targets, to improve the student's proficiency in many differing circumstances under which his technique must equip him to perform.

Further objects are to provide a system as described which is effective, safe and economical to use, which is simple and reliable in operation, which is attractive and interesting in appearance, and which is durable and abuse-resistant.

In brief summary given as cursive description only and not as limitation, the invention includes a punch-receiver having a meter for indicating punch power.

The above and other objects and advantages of this invention will become more readily apparent on examination of the following description including the drawings in which:

FIG. 5 is a perspective view of a third embodiment;

FIG. 6 is a front elevational view of a fourth embodiment;

FIG. 7 is a front elevational view of a fifth embodiment;

FIG. 8 is an elevational detail of a sixth embodiment; and

FIG. 9 is an elevational detail of a seventh embodiment.

Figure 1:
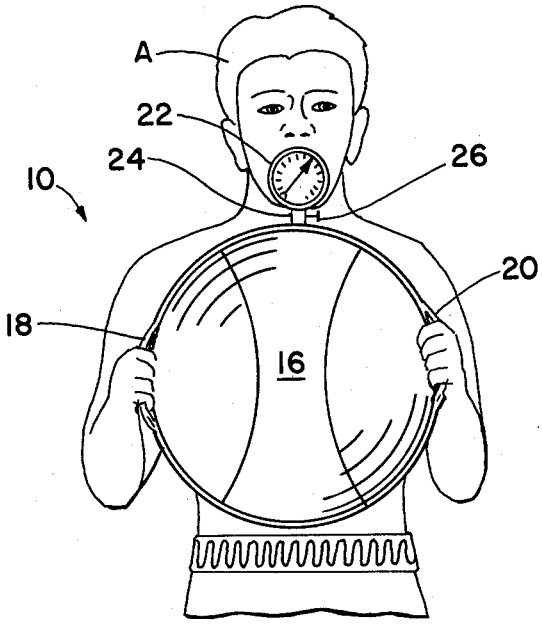
FIG. 1 is a front elevational view of a first embodiment of the invention in use.

FIG. 1 shows the invention 10 embodied in a pneumatic compartment or light spherical bag 16 of the inflated medicine ball type having around the equator a strap attached at intervals, forming handles 18, 20, and at an upper portion, preferably at the top central or north pole position a pneumatic pressure meter 22 connected with gas inflating the bag by a check valve 24 which forwards punch-induced pressure increase to the meter and permits holding a pressure reading until released. The check valve may be of the common ball-check type with the ball forced against a seat by a spring, the seat being on the side adjacent the bag, and a release plunger 26 operating through a hermetic seal permitting manual unseating of the ball to reset to zero the pneumatic pressure meter, when desired. Preferably the meter is calibrated in pounds per square inch, and the bag is of constant-volume or non-stretch design for greater accuracy of indication.

In operation, an assistant A holds the bag against his torso or his shoulder in the usual manner while the one practicing punches the bag. Pressure readings may be observed by either, depending on the orientation of the bag, since the meter is so-positioned relative to the handles to permit this. The assistant may reset the meter after each reading or after the highest reading a series of punches registers. Alternatively, it is evident, the meter release may be taped, omitted, or otherwise fixed in the release position and the movement of the needle of the gauge simply observed during the practicing to give an index of the proficiency and improvement in technique of the boxer. Pressure releases back into the bag from the meter.

Figure 2:
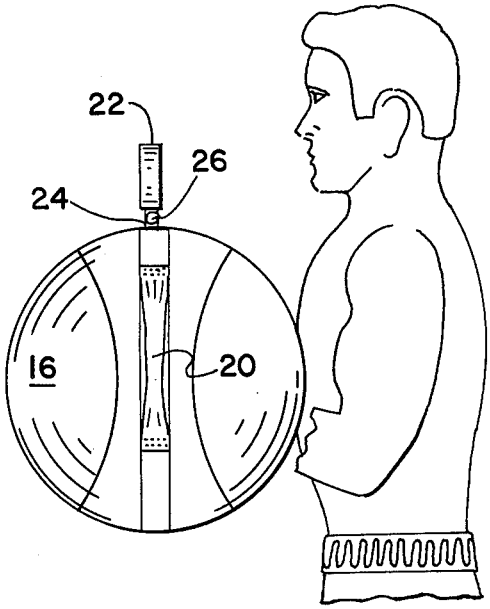
FIG. 2 is a side elevational view of the first embodiment.

FIG. 2 shows the advantageous positioning of the meter 22 relative to the assistant, and by similar reasoning, relative to the boxer practicing. The meter is in good reading distance from either and is as well spaced to prevent accidental injury to either as the size of the bag permits.

Figure 3:
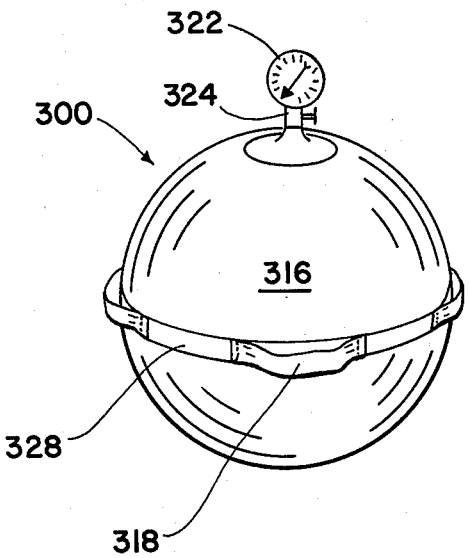
FIG. 3 is a perspective view of a second embodiment.
Figure 4:
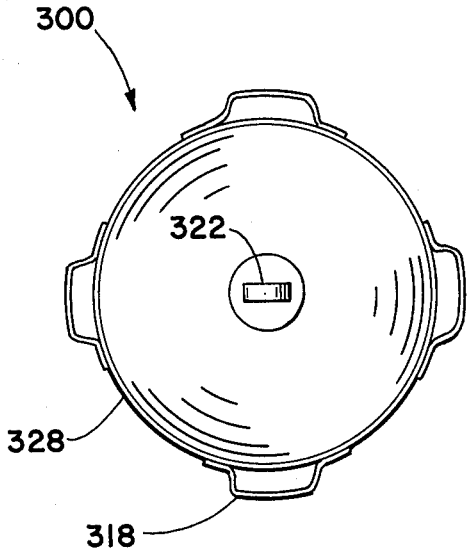
FIG. 4 is a plan view of the second embodiment.

FIGS. 3 and 4 show a further embodiment 300 similar to the first embodiment but with a reinforcing strap ring 328 around the middle or equator position of the bag and four strap handles like handle 318 equally spaced around the reinforcing ring in alignment with the meter 322.

This permits facing the meter to either side as well as to front or back, as desired.

FIG. 5 shows a further embodiment 500 of the invention in which the meter-valve assembly 522, 524 is installed in a laterally protrusive location on an elongate inflated bag 516 having a rotatable suspension supporting means 518 which may include a swivel 530. Depending on the orientation of the bag, the meter can be visible to the user or to an observer at any other position around the bag (phantom lines).

FIGS. 6 shows an embodiment 600 based on a conventional "heavy bag", essentially a cylindrical mass 632 of jute or other suitable mass-imparting material. Overlying a portion of the cylindrical mass, but preferably within the outer cover 634 seen connecting it with the suspension 618, pneumatic pressure container or compartment 616 having a check-valve 624 and a meter 622 connected with it as before. The compartment is is position to be forced against the overlaid portion of the cylindrical mass by an accurately aimed punch. Preferably, the meter is located generally flat against the bag at an upper portion as shown, clear of the area normally struck and connected by conventional means such as clamp-ring-and-gasket, not shown.

As an optional feature, any other portion of the mass may be overlaid with a second or further compartment 616' of the same type, preferably flexible, constant-volume, contained within the outer cover, and having a suitable similar-material duct 636 connecting it with the first compartment. This permits target practice between alternate positions at the same time stressing accuracy, power and footwork in striking spaced predesignated limited areas of the punching bag. If desired, the duct may be tied-off at a convenient location such as 638 to take the second pneumatic compartment out of the pressure-registering circuit, and pressure releasing circuit as a bag.

FIG. 7 shows an embodiment 700 in which the pneumatic compartment 716 circumferentially overlies the heavy bag cylindrical mass 732, preferably full-length to permit boxers of all heights to practice using the invention. If desired at intervals the outer wall **716*a* of the pneumatic compartment may be tied to the inner wall 716*b* as at 740; the inner wall snugly fits the mass in any case, and can be a slip-on accessory held by hooks 742** at the top, if desired, so that it can be applied to any suitable bag. This embodiment, it can be seen, will register the force of a hit substantially anywhere on the cylindrical exterior, permitting the invention to be used with little regard for exact area hit. In this embodiment the pneumatic compartment can simply be double-wall sleeve slipped in place and fixed by inflation, tape, or other customary means.

FIG. 8 is a detail of an embodiment 800 similar to that of FIG. 6, showing that the pneumatic pressure meter and valve 822, 824 can be recessed and covered by a transparent plastic cover 844 flush with the exterior.

FIG. 9 shows an embodiment 900 with recessed, flush covered pneumatic pressure meter and valve, 922, 924 safely recessed and covered by a plastic cover 944 in a medicine ball type device. Access to the valve can be by flexing of the overlying structure or by a finger opening, not shown.

It will be apparent from the foregoing that the means of gauging power of punches objectively on a scale is provided, and that the device is simple and lightweight and fully portable and depends on no fixed installation or connection or complicated hookup, and requires no complicated interpretation to judge progress of an individual boxer.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In boxing practice apparatus including a punching bag or the like, means for supporting the punching bag, means for indicating punch power, including a pneumatic pressure compartment associated with at least a portion of said punching bag in position for receiving punches during boxing practice, a pneumatic pressure meter, and means connecting said pneumatic pressure compartment with the pneumatic pressure meter for thereby forwarding pressure increase to and indicating punch power on the pneumatic pressure meter as a function of punch-induced pressure increase in said pneumatic pressure compartment, the improvement comprising: the means connecting said pneumatic compartment with the pneumatic pressure meter including a check valve for holding a said pressure increase in the pneumatic pressure meter, the check valve having manually actuable means for releasing pressure from the pneumatic pressure meter through the check valve into the punching bag for resetting the pneumatic pressure meter, the pneumatic pressure meter being located at the top central portion of the punching bag, the punching bag being spherical and the means for supporting including four strap handles equally spaced around the equator thereof located in position for alternatively holding the punching bag with the pneumatic pressure meter facing toward, or away from, or to either side of, a user during boxing practice.

* * * * *